United States Patent [19]

Omori et al.

[11] Patent Number: 4,992,309

[45] Date of Patent: Feb. 12, 1991

[54] METHOD FOR SALT BATH-NITRIDING METAL MEMBER

[75] Inventors: Takesi Omori, Kobe; Osamu Matsumoto; Tatsuo Horimoto, both of Himeji, all of Japan

[73] Assignees: Mitsubishi Denki Kabushiki Kaisha, Tokyo; Shonan Chikka Kogyo Co, Ltd., Fujisawa, both of Japan

[21] Appl. No.: 405,289

[22] Filed: Sep. 11, 1989

[30] Foreign Application Priority Data

Sep. 12, 1988 [JP] Japan ..... 63-228075

[51] Int. Cl.[5] ..... C23C 2/00

[52] U.S. Cl. ..... 427/431; 427/435; 427/430.1

[58] Field of Search ..... 427/431, 435, 430.1

[56] References Cited

FOREIGN PATENT DOCUMENTS 2483962 12/1981 France ..... 427/431

144435 12/1978 Japan ..... 427/431

*Primary Examiner*—Shrive Beck

*Assistant Examiner*—Vi Duong Dang

*Attorney, Agent, or Firm*—Oblon, Spivak, McClelland, Maier & Neustadt

[57] ABSTRACT

A method for salt bath-nitriding a metal member having a blind hole, which comprises supporting the metal member so that the open side of the blind hole is directed upward, filling a salt bath-nitriding agent into the blind hole and immersing the resultant metal member in a salt bath melt.

3 Claims, 1 Drawing Sheet

METHOD FOR SALT BATH-NITRIDING METAL MEMBER

BACKGROUND OF THE INVENTION

1. Field of the Invention

The present invention relates to a method for salt bath-nitriding a metal member having a blind hole, the improvement of which resides in that the interior surface of the blind hole is completely nitrided.

2. Discussion of Background

A conventional method of salt bath-nitriding a metal member having a blind hole is carried out as shown in FIGS. 3 and 4. In FIG. 3, numeral 1 indicates a metal member to be nitrided, which has a blind hole 1*a*. The conventional method for salt bath-nitriding is carried out by supporting a plurality of metal members 1 by a supporter (not shown) so that the open side of the blind hole 1*a* is directed upward and immersing them in a salt balt melt 2 in a salt bath tank (not shown) as shown in FIG. 4.

In such a method, the salt bath melt 2 does not completely invade into the bottom of the blind hole 1*a* and a residual air 3 often remains at the bottom of the blind hole 1*a* particularly when the diameter of the blind hole 1*a* is small.

In order to avoid this defect, there is another conventional method carried out as in FIG. 5. A plurality of metal members 1 are laid horizontally and supported by a supporter (not shown). These members are immersed in a salt bath melt 2 in a salt bath tank (not shown) to be salt bath-nitrided as shown in FIG. 6.

However, even by this method, the melt 2 does not completely replace the air in the interior of the blind hole 1*a*, and accordingly the residual air 3 often remains at the innermost bottom of the hole 1*a* when the diameter of the blind hole 1*a* is small.

Such formation of the residual air 3 at the bottom of the hole could not be prevented even when a through-hole with a very small diameter, for example, a perforation of a diameter of 1 mm, was provided at the bottom of the blind hole 1*a* of the metal member 1.

Thus, the conventional methods for salt bath-nitriding metal members as mentioned above, have a problem that air 3 remains at the bottom of the blind hole 1*a* and consequently the bottom part is not nitrided when the metal member 1 is immersed in the salt bath melt 2.

SUMMARY OF THE INVENTION

An object of the present invention is to solve the above-mentioned problem, and provide a method for salt bath-nitriding a metal member having a blind hole, whereby the interior surface of the blind hole is completely nitrided.

Thus, the present invention provides a method for salt bath-nitriding a metal member having a blind hole, which comprises supporting said metal member so that the open side of said blind hole is directed upward, filling a salt bath-nitriding agent into said blind hole and immersing the resultant metal member in a salt bath melt.

BRIEF DESCRIPTION OF THE DRAWINGS

In the accompanying drawings.

DETAILED DESCRIPTION OF THE PREFERRED EMBODIMENTS

The present invention will be described in detail with reference to the preferred embodiment.

According to the present invention, when the metal member having a salt bath-nitriding agent filled in the blind hole is immersed in a salt bath melt, the salt bath-nitriding agent is gradually melted and percorates into the inner most bottom of the blind hole, whereby the interior surface of the blind hole will be completely nitrided.

EXAMPLE

Figure 1:
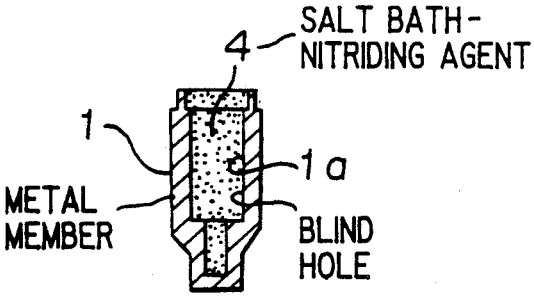
FIGS. 1 and 2 illustrate one embodiment of the method for salt bath-nitriding of the present invention according to the process steps.

The method for salt bath-nitriding a metal member according to the present invention will be explained with reference to FIGS. 1 and 2. First, as shown in FIG. 1, a metal member 1 is positioned so that the open side of a blind hole 1*a* is directed upward and a salt bath-nitriding agent 4 is filled in the blind hole 1*a*. The salt bath-nitriding agent 4 is powder-like at room temperature.

Examples of a metal member 1 to be nitrided include SUS, SCM or the like.

Examples of a salt bath-nitriding agent 4 include a mixture of (i) alkali cyanate (essential working ingredient), (ii) alkali cyanide (supplying ingredient for said working ingredient) and (iii) alkali carbonate or chloride-containing alkali carbonate (subsidiary ingredient for accelerating the working of the salt bath-nitriding agent), a mixture of (i) alkali cyanurate or alkali isocyanurate (essential working ingredient) and (ii) alkali carbonate or chloride-containing alkali carbonate or the like. A salt bath-nitriding agent is well known, and is fully described in Japanese Examined Patent Publication No. 4146/1981 (Patent No. 1,061,359).

Figure 2:
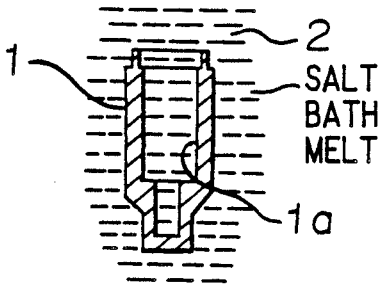
Figure 3:
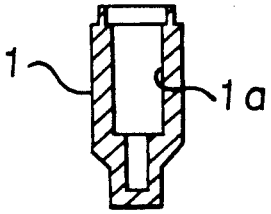
FIGS. 3 and 4 illustrate a conventional method for salt bath-nitriding according to the process steps.
Figure 4:
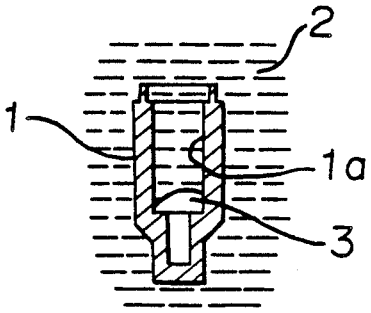
Figure 5:
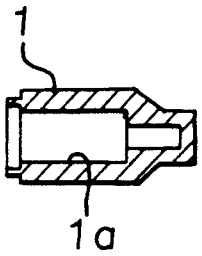
FIGS. 5 and 6 illustrate another conventional method for salt bath-nitriding according to the process steps.
Figure 6:
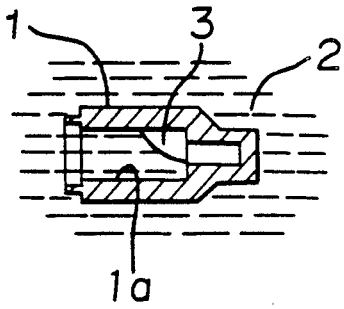

A plurality of the metal members 1 in this state are supported by a supporter (not shown) and are immersed in a salt bath melt 2 in a salt bath tank (not shown), thereby being nitrided as shown in FIG. 2. The powder-like salt bath-nitriding agent 4 in the blind hole 1*a* immersed in the salt bath melt 2 is melted by being exposed to high temperature, and percorates into the bottom of the blind hole 1*a*. In this manner, nitriding treatment is carried out without leaving a residual air at the bottom of the blind hole, as formed in the conventional method.

A salt bath melt 2 is generally prepared by melting a salt bath-nitriding agent, and has substantially the same composition as that of the salt bath-nitriding agent.

Thus, according to the present invention, the interior surface of the blind hole 1*a* of a metal member 1 is completely nitrided and a totally uniform nitride layer is formed even when the diameter of the blind hole 1*a* is small.

The yield of a nitrided metal member 1 of good and acceptable quality was from 10 to 20% in the conventional method, but 100% in the method of present invention.

As mentioned above, according to the present invention, the interior surface of the blind hole with even a small diameter can be completely nitrided by supporting the metal member so that the open side of the blind hole is directed upward, filling a salt bath-nitriding agent into said blind hole and immersing the resultant metal member in a salt bath melt.

What is claimed is:

1. A method for salt bath-nitriding a metal member having a blind hole, which comprises supporting said metal member so that the open side of said blind hole is directed upward, filling a solid salt bath-nitriding agent into said blind hole and immersing the resultant metal member in a salt bath melt.

2. The method according to claim 1, wherein the salt bath-nitriding agent is a powder.

3. The method of salt bath-nitriding a metal member according to claim 1 wherein said solid salt bath-nitriding agent is a mixture of alkali cyanate, alkali cyanide and alkali carbonate or chloride-containing alkali carbonate, or a mixture of alkali cyanurate or alkali isocyanurate and alkali carbonate or chloride-containing alkali carbonate.

* * * * *